United States Patent [19]

Smeltz

[11] 4,310,426

[45] Jan. 12, 1982

[54] DURABLE, ANTISTATIC, SOIL RELEASE AGENT

[75] Inventor: Kenneth C. Smeltz, Wilmington, Del.

[73] Assignee: E. I. Du Pont de Nemours and Company, Wilmington, Del.

[21] Appl. No.: 184,478

[22] Filed: Sep. 5, 1980

Related U.S. Application Data

[63] Continuation-in-part of Ser. No. 932,398, Aug. 9, 1978, abandoned.

[51] Int. Cl.[3] ..... C08G 12/30; B05D 3/02; D04H 1/58; B32B 27/00

[52] U.S. Cl. ..... 252/8.8; 528/254; 252/8.9; 427/393.1; 427/393.4; 428/288; 428/290

[58] Field of Search ..... 8/115.6; 252/8.8, 8.9; 427/393.1, 393.4; 428/288, 290, 474, 480, 524; 528/254

[56] References Cited

U.S. PATENT DOCUMENTS

| | | |
|---|---|---|
| 2,892,810 | 6/1959 | Albrecht . |
| 3,754,859 | 8/1973 | Doerr . |
| 3,996,226 | 12/1976 | Savostianoff et al. . |
| 4,104,443 | 8/1978 | Latta et al. . |
| 4,115,605 | 9/1978 | Hultman et al. . |

FOREIGN PATENT DOCUMENTS

| | | |
|---|---|---|
| 49-8439 | 2/1974 | Japan . |

*Primary Examiner*—Michael R. Lusignan

[57] ABSTRACT

Yellowing resistant, durable antistatic soil release agent:

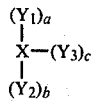

wherein

X is an aminoplast resin moiety having amino nitrogen atoms and 4 to 6 methylene groups, each of which methylene groups is attached to an amino nitrogen atom;

$Y_1$ is $O(C_2H_4O)_{5\text{-}20}R_1$;

$R_1$ is $C_{1\text{-}5}$ alkyl;

$Y_2$ is $O(C_2H_4O)_{5\text{-}88}R_2$;

$R_2$ is $C_{6\text{-}20}$ alkyl;

$Y_3$ is

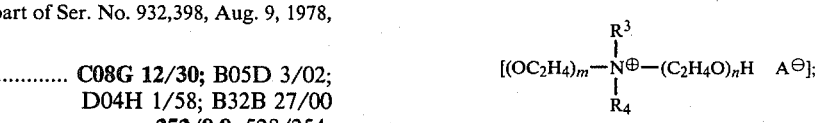

$R_3$ is $C_{4\text{-}20}$ alkyl, $C_{4\text{-}20}$ alkenyl or benzyl;

$R_4$ is $C_{1\text{-}4}$ alkyl;

$A^{\ominus}$ is an organic or inorganic anion; each of a and b can be 0 to 2, provided that the sum of a and b is 1 to 2;

c is 1 to 2;

the sum of a, b and c is 2 to 4;

each of m and n is at least 1 and the sum of m and n is 12 to 100;

said agent having HLB of 14.5 to 18.0, Brookfield viscosity (20 weight % aqueous solution viscosity at 20° C.) of 0.250 to 16.000 pascal seconds, electrical resistivity (Keithley Log R) on polyester fabric (20±2% RH, 23°±1° C.) less than 13.00 initially and 14.25 after 10 washes, and soil release (polyester fabric) at least 3 initially; process comprising (a) diluting agent with normally liquid medium to desired viscosity;

(b) adding ammonium or mono-, di- or trivalent metal salt to achieve cloud point less than 100° C. but greater than 25° C., or adding polyacidic compound having second dissociation constant greater than $1\times10^{-8}$ to pH 3.0 to 6.0, or adding both, (c) applying step (b) agent to substrate, and (d) drying, curing and recovering treated substrate.

21 Claims, No Drawings

DURABLE, ANTISTATIC, SOIL RELEASE AGENT

CROSS REFERENCE TO RELATED APPLICATIONS

This is a continuation-in-part of Application Ser. No. 932,398, filed Aug. 9, 1978, and now abandoned. Moreover, in Application Ser. No. 156,641, filed June 5, 1980, now U.S. Pat. No. 4,279,960, patented July 21, 1981, Smeltz and Strickler disclose and claim a method for applying the compositions of this invention.

TECHNICAL FIELD

This invention relates to a chemical composition which can be used to impart durable, antistatic, soil release and, to some extent, anti-soil redeposition characteristics to a substrate treated therewith. It relates further to a substrate which exhibits durable, antistatic, soil release and, to some extent, antisoil redeposition properties. It relates particularly to such a composition which is useful in the textile trade.

BACKGROUND ART

Extensive prior art exists in the fields of antistatic agents and soil release agents. Such materials are used extensively to impart antistatic and soil release characteristics to substrates treated therewith, particularly textile materials, such as textile fabrics.

For example, Albrecht, in U.S. Pat. No. 2,892,810 discloses cation-active derivatives which are said to be suitable for improving the electrical conductivity properties of synthetic textiles. Among the numerous derivatives included in the Albrecht patent are derivatives of aldehyde condensation products of aminotriazines or ethers thereof with alcohols of low molecular weight, which derivatives contain cation-active amino groups and groupings which increase the hydrophilic character non-ionically, such as polyglycol ether groups.

On the other hand, Savostianoff et al., in U.S. Pat. No. 3,996,226, discloses chemical compounds which are said to impart antistatic properties to natural and synthetic fabrics, which compounds have the general formula

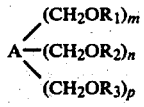

in which A is a radical resulting from the removal of at least three atoms of hydrogen replaceable by methylols on atoms of nitrogen of a compound capable of supplying aminoplasts; $R_1$ is either a hydrogen atom or an alkyl or acyl radical comprising less than 4 atoms of carbon; $R_2$ is an aliphatic alkyl or acyl radical comprising at least 10 atoms of carbon or aliphatic alkyl or acyl radical comprising at least 10 atoms of carbon or an alkyl radical comprising at least 2 atoms of carbon and at least one halogen substituent; $R_3$ is a radical resulting from the removal of a hydroxyl from the alcohol group of the addition product of 5 to 30 molecules of identical or different alkylene oxides on an alcohol or an acid; and m, n and p are equal to or greater than 1.

Latta et al., in U.S. Pat. No. 4,104,443, disclose an antistatic finish which is said to be durable on synthetic polymer fabric. Latta et al. apply to the fabric a mixture of a melamine derivative (prepared by reacting melamine with either formaldehyde or formaldehyde and an alkanol) and ethoxylated compounds having the formula

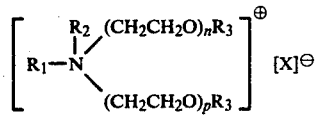

and

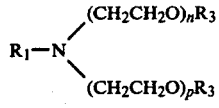

wherein $R_1$ is $C_{8-20}$ alkyl;

$R_2$ is a $C_{1-22}$ alkyl; or $-(CH_2CH_2O)_rR_4$;

$R_3$ is hydrogen, $-CH_2CH_2NH_2$ or $-CH_2CH_2SH$;

$R_4$ is hydrogen, $-CH_2CH_2NH_2$, $-CH_2CH_2SH$ or $C_{1-4}$ alkyl;

n, p and r are 5 to 60, and $X^{\ominus}$ is an anion.

A desirable feature of antistatic and soil release agents is durability, that is, the ability of the agent to be retained on the substrate during subsequent handling or use thereof. For example, in the case of textile fabrics; such as clothing, it is desirable that any antistatic or soil release property imparted to the fabric be retained thereon through subsequent laundering operations. A need exists for a single substrate treating agent or composition which can impart durable, antistatic soil release properties to the substrate.

DISCLOSURE OF THE INVENTION

The invention relates to a durable antistatic soil release agent which is resistant to yellowing on the substrate treated therewith, and to substrate treated with the agent which is of the formula

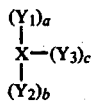

wherein

X is an aminoplast resin moiety having amino nitrogen atoms and 4 to 6 methylene groups, each of which methylene groups is attached to an amino nitrogen atom;

$Y_1$ is $O(C_2H_4O)_{5-20}R_1$;

$R_1$ is $C_{1-5}$ alkyl;

$Y_2$ is $O(C_2H_4O)_{5-88}R_2$;

$R_2$ is $C_{6-20}$ alkyl;

$Y_3$ is

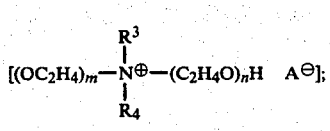

$R_3$ is $C_{4-20}$ alkyl, $C_{4-20}$ alkenyl or benzyl;

$R_4$ is $C_{1-4}$ alkyl;

$A^{\ominus}$ is an organic or inorganic anion;

each of a and b can be 0 to 2, provided that the sum of a and b is 1 to 2;

c is 1 to 2;

the sum of a, b and c is 2 to 4;

each of m and n is at least 1 and the sum of m and n is 12 to 100;

said agent having a calculated hydrophile-lipophile balance (HLB) of 14.5 to 18.0, a 20 weight % aqueous solution viscosity, as measured at 20° C. on a Brookfield viscometer, of 250 to 16,000 cps (0.250 to 16.000 pascal seconds), an electrical resistivity (Keithley log R) on polyester fabric, at 20±2% relative humidity (R.H.) and 23°±1° C., of no greater than 13.00 initially and no greater than 14.25 after 10 washes, and a soil release rating on polyester fabric of at least 3 initially. Preferably, each of a and b is 1 or 2. More particularly, $Y_1$ is $O(C_2H_4O)_{10-16}CH_3$; $Y_2$ is $O(C_2H_4O)_{15-30}C_{13}H_{27}$; $R_3$ is $C_{8-18}$ alkyl, or $C_{8-12}$ alkyl to achieve good water wettability (drop absorption), $R_4$ is $CH_3$, $A^{\ominus}$ is $^{\ominus}OSO_3CH_3$ and m+n is 20 to 50; the HLB is 15.5 to 17.0; and the 20% aqueous viscosity is 2,000 to 8,000 cps (2.000 to 8.000 pascal seconds).

Although it will be described in greater detail hereinafter, the process of the invention resides in a process for applying the aforesaid agent to a substrate, which process comprises the steps:

(a) diluting the agent with a normally liquid medium to achieve the desired application liquid viscosity, (b) adding sufficient salt of a mono-, di- or trivalent metal or of an ammonium cation to achieve a cloud point, of the diluted agent of step (a), of less than 100° C. but greater than 25° C., or adding sufficient polyacidic compound having a second dissociation constant of greater than $1\times10^{-8}$ to achieve a pH, of the diluted agent of step (a), of 3.0 to 6.0, or adding both said salt and said polyacidic compound to achieve said cloud point and pH, (c) applying the diluted agent of step (b) to the substrate to be treated so as to achieve the desired level of agent on the substrate, (d) drying and curing the agent on the substrate, and (e) recovering substrate which has been durably treated with the agent of the aforesaid formula.

Finally, the invention herein also resides in substrate which has been durably treated with the aforesaid agent.

The agent of the invention is prepared by conventional techniques by contacting, in appropriate amounts, under appropriate reaction conditions, appropriate precursors of the aforesaid moieties X and $Y_3$ and the optional moieties $Y_1$ and $Y_2$.

Exemplary of X moiety precursors which can be used to produce the agent of the invention are the melamine methylol derivatives having 4 to 6 methylol groups, which methylol groups can be ether capped with, for example $C_{1-4}$ alkyl. The optional $Y_1$ and $Y_2$ moieties can be provided by the commonly available polyethylene oxides. For example, polyethylene glycol monoethers having 5 to 20 ethyleneoxy moieties and $C_{1-5}$ alkyl ether end groups are commercially available under the Carbowax® designation, thus providing a source of the $Y_1$ moiety. Similarly, the $Y_2$ moiety is provided by commercially available materials, such as those designated Merpol®, which are polyethylene glycol monoethers having 5 to 88 ethyleneoxy moieties and $C_{6-20}$ alkyl ether end groups.

The preparation of $Y_2$ precursors proceeds as follows:

One mole of the appropriate $C_6$–$C_{20}$ alkyl alcohol is dried to ≦0.2 weight % water, either thermally under nitrogen purge or under reduced pressure (if the boiling point of the alcohol is high enough). About 0.5 part of sodium hydride (or a similar catalyst) is then added to the alcohol, with stirring, at 80°–100° C., under a nitrogen atmosphere. After 15–60 minutes of agitation, the temperature is increased. When the alcohol temperature is about 140° C., the nitrogen purge is stopped and ethylene oxide is introduced. The temperature is allowed to reach about 155° C. The addition of ethylene oxide is continued at this temperature until a total of 5 to 88 moles (depending on the ethylene-oxide content desired) is added per mole of alcohol present. After addition and reaction of the ethylene oxide is complete, any sodium alcoholate formed (from the sodium hydride) is neutralized at about 70° C. with an equivalent amount of acid, such as p-toluenesulfonic acid. The finished product, if it is not used immediately, can be stored in a sealed container until needed.

The $Y_3$ precursors can be prepared as follows:

One mole of the appropriate n-alkylamine is heated under a nitrogen purge to at least 120° C., preferably within the range 185° to 230° C. The nitrogen purge is discontinued and ethylene oxide is introduced and reacted with the amine to produce N,N-bis-2-hydroxyethyl-n-alkyl amine according to the procedure of H. L. Sanders, J. B. Braunwarth, R. B. McConnell and R. A. Swenson, J. Am. Oil Chem. Soc., 46 167 (1969). The lower molecular weight bis-2-hydroxyethyl-n-alkylamines are commercially available. About 1 part of 50–60 weight % sodium hydride in oil is then added to the one mole of the bis-2-hydroxyethyl-n-alkylamine under a nitrogen purge at 50°–100° C. The mixture is heated with agitation under nitrogen to about 140° C. The nitrogen purge is discontinued, ethylene oxide is introduced and the reaction is run at 140°–170° C., preferably at 155°–165° C. Ethylene oxide addition is continued until the desired amount has reacted with the bis-2-hydroxyethyl-n-alkylamine. Then nitrogen purging is resumed while the product is cooled to about 80° C. An amount of acid, such as dry p-toluenesulfonic acid, equivalent to the 100% sodium hydride used is then added. The resultant tertiary polyethyleneoxy-n-alkylamine is quaternized by the following conventional procedure.

If a commercially available tertiary polyethyleneoxy-n-alkylamine is used, it should be dried 2–4 hours at 90°–95° C. with agitation under reduced pressure (30–50 mm of mercury; 3,999.7 to 6,666.1 pascal). To one mole of the aforesaid tertiary amine is slowly added, with agitation, 0.99–1.0 mole of dimethyl sulfate over a 1–4 hour period while the reaction mixture is kept at 50°–60° C., after which the mixture is agitated for an additional 8–20 hours at 50°–60° C. When the reaction is complete, the product can either be used directly in the subsequent condensation step or stored until such use.

The agent of the invention can be prepared by the following general procedure. Although the procedure given below applies to the preparation of an agent of the aforesaid formula having $Y_1$, $Y_2$ and $Y_3$ moieties, it will be obvious to one skilled in the art that other agents of said formula wherein one of $Y_1$ and $Y_2$ is absent can similarly be prepared.

A mixture of one mole of the lower alkyl polyethyleneoxy alcohol ($Y_1$ precursor) and one mole of the higher alkyl polyethyleneoxy alcohol ($Y_2$ precursor) is dried and any peroxides therein are eliminated by heating, with agitation, at 170°–190° C. for 2 hours under reduced pressure (20–50 mm of mercury; 2,666.4 to 6,666.1 pascal). After cooling to 80°-90° C. and breaking the vacuum with a nitrogen purge, one mole of the quaternized polyethyleneoxy tertiary amine glycol ($Y_3$ percursor), one mole of predried hexakis(methoxymethyl)melamine (X precursor) (Cymel® 300) and 0.6 weight %, based on the total weight of the components used, of predried p-toluenesulfonic acid are added. With rapid nitrogen purging of the molten mass, the stirred mixture is heated at 90°-95° C. The methanol and small amount of methylal that are evolved can be collected in cold receivers or traps. The total amount of methanol collected should be about three moles. The condensation is continued until the desired product viscosity is reached. An amount of tertiary amine, preferably having a boiling point above 120° C., for example, triethanolamine, which is 50 mole % greater than the molar amount of p-toluenesulfonic acid used is added immediately to the viscous mass to stop the reaction. The nitrogen flow rate and stirring rate are reduced while the amine neutralizes the acid at 85°-95° C. (10-20 minutes).

The above 100% condensate can be stored as is or used directly. However, for most uses, such as the treatment of textile fabrics, it is diluted (by suspending or dispersing or by dissolving in a normally liquid medium) to a manageable viscosity, for example, the desired application liquid viscosity, so that it can be applied by conventional techniques, for example, by padding or exhaust. If the aforesaid 100% condensate has been stored at room temperature, it will be a solid and must be thawed at a temperature of at least 50° C., preferably under a nitrogen atmosphere. The condensate can be diluted with a normally liquid (at 25° C.) medium until the desired (manageable) viscosity is achieved. The liquid medium preferably should be miscible with the agent of the invention and the salt and/or polyacidic compounds discussed herein, nonreactive therewith at least up to about the cure temperature, and removable by volatilization at least by the cure temperature. Suitable liquid media include water, alcohols, ketones, esters, ethers and aromatic hydrocarbons. A convenient liquid medium for textile treating operations is water.

Most of the description herein relates to the use of water as the normally liquid medium in connection with the utility of the agent of the invention as a durable, antistatic, soil release agent for textile fabrics. It will be readily apparent to one skilled in the art that other substrates can be treated with the agent of the invention to achieve durable antistatic and soil release characteristics. For example, the agent of the invention can be used to treat textile fibers which may or may not subsequently be converted to fabric and to treat substrates which are flexible or nonflexible shaped structures of polymeric materials other than textile fibers and fabrics, for example, molded articles as well as extruded products, such as film and tubing.

If water is used as the normally liquid diluting medium, a weighed portion of the viscous condensate is added slowly to a rapidly stirred quantity of water (the addition of water to the condensate may yield a difficult-to-manage gel-like material). After the condensate dissolves, the mixture is made alkaline to minimize hydrolysis of the product on storage; for example, the pH is adjusted to 7.7-8.2 by addition of sodium bicarbonate. If desired, enough water can be added to bring the mass to, for example, a 20 weight % aqueous solution. Such a solution has a Brookfield viscosity of 250 to 16,000 cps (0.250 to 16.000 pascal seconds) at 20° C. In the treatment of fabrics, a more dilute aqueous solution is used, for example, less than 1 weight % in an exhaust application.

The agent of the invention has a calculated hydrophile-lipophile balance (HLB) of 14.5 to 18.0 and a 20 weight % aqueous solution viscosity, as measured on a Brookfield viscometer, of 250 to 16,000 cps (0.250 to 16.000 pascal seconds). In general, all other variables being maintained constant, the higher the viscosity, the better will be the durability achieved with the agent of the invention on the fabric being treated.

The Brookfield viscosity is determined by the American Society of Testing Materials Test Method D-1824, modified, with the modifications thereto being as follows:

1. Viscosities are measured at 25°±0.4° C.
2. Samples are bubble-free when viscosities are determined.
3. Viscosity is determined one to three times, on a given sample, at about the same time.
4. Viscosities are reported in centipoises (cps; pascal seconds).

The hydrophile-lipophile balance (HLB) system is the subject of numerous publications, for example, "Classification of Surface-Active Agents by HLB," W. C. Griffin, J. Soc. Cosmetic Chemists 1, 311 (1949); "Calculation of HLB Values of Non-ionic Surfactants," ibid. 5, 249 (1954); "The Atlas HLB System," Atlas Chemical Industries, Inc., Wilmington, Delaware, 4th printing, May, 1971; Proceedings 2nd Int. Congr. Sur. Act. 1, 426 (1957), Academic Press, New York, N.Y. HLB values reflect the hydrophilic content of the molecule. In accordance with the information available from the aforesaid publications, calculated HLB values are determined herein by means of the equation:

$$\frac{\text{sum of the molecular weights of all the hydrophilic moieties of the molecule}}{\text{molecular weight of the entire molecule}} \times 20 = \text{Calculated } HLB.$$

The agent of this invention is particularly useful as a textile treating agent for fabrics of synthetic fibers, including woven, nonwoven and knit fabrics of either spun or filamentary type fibers. The fabrics can be of the blended or unblended fiber type. Fabrics treated with the agent exhibit good to excellent antistatic, soil release and, to some extent, anti-soil redeposition characteristics. Moreover, the agent does not substantially affect the hand of the fabric, and the agent appears to be non-toxic, it can be applied topically using pad or exhaust techniques, it is durably retained by the fabric after being applied thereto and it is resistant to yellowing on the fabric. Fabrics particularly suitable to treatment with the agent of this invention include those of polyester, polyamide, polyacrylic or acetate fibers. Qiana®, Nomex®, Dacron® and nylon taffeta fabrics, for example, can be usefully treated by means of this invention.

It is to be understood that the previous discussion of preparative procedures of the agent of the invention and the following examples (within the invention) and experiments (outside the invention) are intended merely as guidelines to enable one skilled in the art to practice the invention. Modifications of the preparative procedures disclosed herein will be readily apparent. It is to be further understood that the parameters set forth above for the agent of the invention are important to achieving the objects of the invention. Control of preparative conditions is important to achieving the requisite parameters of the agent and, although the details given above and hereinafter in the examples are believed to be adequate to practice the invention, ultimate determination of such practice usually is carried out by evaluating the agent, promptly after it is prepared, as to its various characteristics according to the procedures set forth below.

The fabric used in the evaluation of the agent of the invention is produced from commercially available Dacron ® Polyester Fiber Type 56. The fabric is white, undyed 150/34 (denier/gauge) double-knit fabric. The fabric is scoured at 71° C. for 20 minutes with 0.5 gram/liter (0.001 $m^3$) of Merpol ® SH nonionic detergent and 1 gram/liter (0.001 $m^3$) of trisodium polyphosphate. After being rinsed well with water the fabric is dried.

The agent to be evaluated is padded onto the fabric so as to give an active ingredient level of 0.8 weight %, based on the weight of dry fabric. A typical pad bath includes the necessary amount of active ingredient, with the bath concentration being adjusted for wet-pickup of the fabric, 0.75 weight % of sodium sulfate, based on the total weight of the bath, and sufficient citric acid to achieve a pH of 4.0. Pad application can be carried out with a commercially available padder, such as a Spartan ® II padder, using two passes and two nips. After padding, the fabric is dried and cured at 199° C. in a forced hot air oven. Curing conditions may vary depending on the wet pick-up of the fabric. Generally, 60 to 75 seconds are adequate for curing at 199° C. A pin frame is used to hold the fabric.

The cured fabric is rinsed in Permutit ® water to remove residual salts or acids and then dried, for example, in a commercially available Sears Roebuck dryer, at 71°±5° C. The agent of the invention is tested for its antistatic characteristic on the fabric using the American Association of Textile Chemists and Colorists (AATCC) Test Method 76-1975 with slight modification as described below. Testing of fabric samples is carried out in a dry box at 20±2% relative humidity and 23°±1° C., the humidity being controlled by a commercially available Hygrometer Indicator Controller (Model 15-3252) with a Model 15-1810 sensing element. Testing equipment includes a Keithley Model 610C Electrometer in combination with a Keithley Model 240A High Voltage Supply and a Model 610S Resistivity Adapter. Further description of this test may be found in the AATCC Technical Manual under the aforesaid test method which is entitled "Electrical Resistivity of Fabrics." Testing of fabric samples is carried out initially (after rinsing) and then after five and ten home laundering/tumble dry cycles, commonly referred to as home wash/tumble dry (HWTD) cycles. The antistatic (A.S.) data appear in the accompanying tables under the heading "A.S.," with the symbols "I, 5W, 10W" being used to indicate the antistatic characteristic initially and after five and ten washes (HWTD cycles), respectively. As indicated above, the agent of the invention must exhibit an electrical resistivity (Keithley Log R), a measure of the antistatic characteristic of the agent, on polyester fabric, at 20±2% relative humidity and 23°±1° C., of no greater than 13.00 initially and no greater than 14.25 after ten washes. For comparison, it may be noted that clean, untreated cotton broadcloth at about 20% relative humidity and about 23° C. exhibits a Keithley Log R of 13.65±0.05. Untreated synthetic fabrics, in general, exhibit Keithley Log R values of 15.5 to 16.0.

The home launderings are carried out, in general, according to AATCC Test Method 124. Equipment used includes a Sears Roebuck Kenmore automatic washer (Model 600) and a Sears Roebuck Kenmore automatic dryer (Model 600). This is the same dryer described above for drying the fabric samples which have been rinsed in Permutit ® water. Test fabric specimens are cut to 20.3 cm squares and introduced into the washer along with "load fabric" (hemmed pieces of cotton sheeting; 97.4 cm squares) to give a total dry load of 1.81 kilograms. To the washer are added 28 grams of Tide ® (commercially available) detergent. Washing is carried out under a normal wash cycle (12 minutes), at the high water level setting, using a hot water temperature of 60°±3° C. The temperature of the rinse water used is 41°±3° C. Soft water (hardness of no more than 5 ppm) is used. For hard water, Calgon ® is added in an amount sufficient to reduce the hardness to a maximum of 5 ppm. Following washing and spin-drying the fabrics are dried in the dryer at a normal cycle time of 45 minutes, with the temperature dial being set on high to give a maximum stack temperature of 71°±9° C. This cycle is repeated to achieve the desired number of home launderings.

The soil release (S.R.) characteristic of the agent of this invention is determined, in general, by AATCC Test Method 130. The treated and cured fabric samples used in the soil release test are prepared in the same manner as those used in the antistatic performance test described above. The soil release test measures the ability of a fabric to release oily stains during home laundering and, as indicated above, the agent of this invention must exhibit a soil release rating on polyester fabric of at least 3 (initial), that is, before being subjected to the home laundering test. Data relative to this test are provided in the accompanying tables under the heading "S.R.", with data being included to show the soil release ratings initially (I) and after five (5W) and ten (10W) washes (HWTD cycles). Test specimens measuring 10 cm×20 cm are conditioned for four hours at 21°±1° C. and 65±2% relative humidity prior to staining. A single flat thickness of test specimen is placed on AATCC Textile Blotting Paper on a smooth horizontal surface and five drops (each having a volume of about 0.2 ml; $0.2\times10^{-6}$ $m^3$) of a commercially available oil test liquid (60 weight % Nujol ® and 40 weight % used piston engine automotive oil) are applied to the test specimen. The oil puddle (total volume, about 1 ml; $1\times10^{-6}$ $m^3$) which is formed is covered by a 7.6 cm×7.6 cm piece of glassine paper and a 2.28 kilogram weight is placed on the paper. After 60 seconds the weight is removed and the glassine sheet is discarded. The oil-stained fabric specimen is then subjected to washing. Washing is carried out within 15 to 60 minutes of staining with such a number of test specimens that the total number of oil stains in the wash does not exceed thirty. Setting a maximum limit on the number of oil stains provides latitude in selecting the number of test specimens used in the event that it is desirable to place more than one oil stain on each test specimen. The aforesaid Kenmore Model 600 automatic washer is filled to the high water level with water at a temperature of 60°±3° C. To the washer are added 140±5 grams of AATCC Standard Detergent 124, or a known equivalent. Then the test specimens and cotton sheeting ballast, so as to make a total load of 1.8±0.1 kilograms, are introduced. The washer is run through a normal wash cycle (12 minutes). Following completion of the spin-dry cycle, the specimens and ballast are placed in the aforesaid Kenmore Model 600 dryer. Drying is carried out at the high setting (70°±6° C.), maximum stack temperature, for 45±5 minutes. The dried test specimens are rated for residual stains within four hours after drying. Evaluation is made by comparing the residual stains in the test specimen with a standard soil release rating chart. Stains are rated to the nearest whole number from 1 to 5. The higher the number, the less is the residual stain.

As stated above, water wettability of the agent of this invention is determined by the drop absorption test which is based in general on AATCC Test Method 39. The test employs the same type of treated/cured fabric specimens described above. Fabric specimens are conditioned at 65±2% relative humidity and 21°±1° C. for at least four hours before testing. Each fabric test specimen is placed over the mouth of the cap of a 5.1–7.6 cm diameter jar. Water is dropped onto the surface of the fabric in a dropwise fashion from a conventional eye dropper (each drop having a volume of about 0.2 ml; $0.2\times10^{-6}$ m$^3$) held about 1 cm above the surface of the fabric. The time is measured, using a stop watch, from the moment that the first drop falls from the dropper until the wet area of the fabric loses its specular reflective power. This can best be observed by placing the fabric between the observer and a source of light, such as an outside window, at such an angle that the specular reflection of light from the surface of the flattened drop (as the drop hits the surface) can be plainly seen. As the drop is absorbed by the fabric, specular reflection of light ceases and a dull wet spot is formed on the fabric. High drop absorption times, for example, above 5 seconds, indicate poor wettability of the treated fabric.

Additional information on all of the aforesaid test procedures may be found in the AATCC Technical Manual.

Optimum benefits from the agent of the invention are achieved using specialized techniques of application that are tailored to the type and characteristics of the fabric being treated. The agent of this invention can be applied by pad or exhaust procedures. In either procedure, the dilute aqueous condensate described hereinabove, for example, the 20 weight % aqueous solution, must include certain acids and/or salts before it is applied to the fabric which is to be treated. The addition of an organic polyacidic compound and/or an inorganic acid which is at least divalent provides antistatic durability of the agent of the invention, when padded onto the fabric, through at least ten washes. The addition of a salt of a mono-, di- or trivalent metal or of an ammonium cation provides both soil release and antistatic durability of the agent, when either padded or exhausted onto the fabric, through at least ten washes. Preferably, to achieve maximum effects for pad application, both the acid and the salt are present along with the agent of the invention. It has been found that, in exhaust application, the salt must be used alone. In other words, exhaust application cannot be carried out with acid alone or with the combination of acid and salt.

The second dissociation constant of the inorganic acid which is at least divalent and that of the organic polyacidic compound must be greater than $1\times10^{-8}$. Examples of such materials include citric, oxalic, tartaric, succinic, glutaric and phosphoric acids. Boric acid, on the other hand, is unsatisfactory because the second dissociation constant is below the aforesaid minimum value. It has been found that low molecular weight polyacrylic acids also are useful herein. Although such materials are polyacidic, the various dissociation constants of the carboxy groups are not readily determinable because of the polymeric nature of the material. The operability of such an acid herein suggests that it meets the aforesaid requirement on second dissociation constant. Useful polyacrylic acids include those which are readily soluble in water. Such materials include those having molecular weights up to at least 5,000. In using the polyacidic compound, alone or in combination with the polyacidic compound, alone or in combination with the salt, the pH of the treating bath should be in the range 3.0 to 6.0, preferably 4.0 to 5.5.

The function of the salt of a mono-, di- or trivalent metal or an ammonium salt, including an appropriate quaternary ammonium salt, appears to be related to its ability to lower the cloud point of the dilute aqueous solution of the agent of the invention below 100° C. The salt should have sufficient ionic strength to lower the cloud point below 100° C. but it should not be such as to insolubilize the product at ambient temperature (25° C.). Lowering of cloud point is determined using a 0.2 weight % aqueous solution of the agent. Examples of salts which may be employed herein alone or in combination with the organic polyacid include, but are not limited to, calcium, magnesium, zinc and sodium nitrates; the sodium phosphates, such as disodium hydrogen phosphate and trisodium phosphate; sodium, magnesium and calcium chlorides; sodium, magnesium, zinc and aluminum sulfates, sodium and ammonium oxalates; calcium acetate and diammonium citrate. Salt hydrates are equally useful. The use of the salt permits selective deposition of the agent of the invention during padding or exhaust; it decreases the mobility of the agent of the invention during the cure cycle and, thus, the agent is retained throughout the fabric (i.e., substantial amounts do not migrate); and it enhances the crosslinking which takes place during the drying/curing step as water is evaporated from the treated fabric. In general, it may be said that the cloud point is raised as the HLB increases but is lowered as the Brookfield viscosity is increased.

To exhaust the agent of the invention onto the fabric, the exhaust bath containing the agent, the appropriate salt, in an appropriate amount, and fabric material is heated to within about 5° to 10° C., for example, about 6° C., of the cloud point and held there until exhaust is complete. This is usually effected in no more than 5 to 10 minutes, for example, 6 minutes. The treated fabric is then removed from the exhaust bath, rinsed or not rinsed (not rinsing is preferred), cooled, extracted of water (using conventional exhaustion techniques to remove excess water) and cured.

Curing conditions will vary depending on the moisture content of the fabric, the higher the moisture content, the longer the time and/or the higher the temperature required. In general, for exhaust and pad applications, curing is carried out at 149° to 204° C. A preferred temperature range is 193° to 199° C. Curing at the preferred temperature conveniently can be carried out in less than one minute, for example, in 15 to 30 seconds, depending on moisture content and the weight of the fabric, when the agent of the invention is applied by exhaust techniques. For padding operations wherein moisture levels are higher, longer times usually are required, for example, 60 to 75 seconds. Durability of the agent of the invention on the fabric requires careful control of curing conditions. Under-curing as well as over-curing will result in diminished durability of the agent. It is to be understood that curing conditions must be determined, for the most part, empirically. For example, a hydrophilic fabric (that is, one retaining moisture readily) will require more rigorous curing conditions than a hydrophobic fabric. Similarly, selection of salt and/or acid, and the amount thereof, are usually determined empirically.

Evidence of the criticality of the curing conditions, in general, is provided in Table I. The table shows the antistatic and soil release behavior of the agent of the invention on the fabric initially and after five and ten washes. The agent used was that of Example 1 and the fabric to which the agent was applied was the same as that described above for test evaluation of the agent of the invention. The agent was applied to the fabric by padding from a pad bath (of such concentration as to give 0.8 weight % of the agent on the fabric, dry weight) containing 0.75 weight % of sodium sulfate, based on the total weight of the bath, and citric acid to a pH of 4.0. Conditions of drying/curing of the treated fabric are given in the table. As noted, in some instances, curing was preceded by a short drying step at a lower temperature.

TABLE I

| | | Cure Conditions | | | | | |
|---|---|---|---|---|---|---|---|
| | | A.S. | | | S.R. | | |
| Time (min) | Temp. (°C.) | I | 5W | 10W | I | 5W | 10W |
| 3 | 149 | 11.62 | 13.25 | 13.25 | 3 | 3 | — |
| 3 | 163 | 11.84 | 13.47 | 13.25 | 3 | 3 | — |
| 2 | 177 | 11.56 | 12.91 | 13.35 | 3 | 3 | — |
| 2 | 191 | 12.43 | 14.13 | 14.61 | 3 | 3 | — |

TABLE I-continued

| | | Cure Conditions | | | | | |
|---|---|---|---|---|---|---|---|
| | | A.S. | | | S.R. | | |
| Time (min) | Temp. (°C.) | I | 5W | 10W | I | 5W | 10W |
| 6 | 149 | 11.81 | 13.39 | 14.17 | 3 | 3 | — |
| 6 | 163 | 12.50 | 14.73 | 15.08 | 3 | 2 | — |
| 6 | 177 | 12.59 | 15.25 | 15.18 | 2 | 1 | — |
| 4 | 177 | 12.70 | 15.69 | 16.03 | 3 | 2 | — |
| 1 | 191 | 11.95 | 14.35 | 15.91 | 3 | 1 | — |
| 1 | 193 | 11.69 | 12.88 | 13.25 | 4 | 3 | 1 |
| 1 | 199 | 11.69 | 13.08 | 13.25 | 3 | 3 | 1 |
| 1 | 204 | 11.62 | 12.83 | 13.07 | 3 | 3 | 1 |
| 1 | 204 | 11.85 | 13.96 | 14.73 | 2 | 1 | — |
| 1.5 | 204 | 11.65 | 13.13 | 13.41 | 3 | 3 | — |
| 0.75 | 204 | 12.10 | 14.69 | 16.73 | 2 | 1 | — |
| 0.75 | 193 | 12.63 | 15.56 | 15.39 | 4 | 1 | — |
| 1 | 193 | 11.56 | 13.50 | 13.65 | 4 | 1 | — |
| 1.25 | 193 | 11.59 | 13.08 | 13.39 | 4 | 4 | — |
| 1.5 | 193 | 11.62 | 13.19 | 13.47 | 4 | 3 | — |
| 0.25* | 193 | 11.24 | 12.81 | 13.08 | 3 | 4 | — |
| 0.5* | 193 | 11.65 | 13.07 | 13.18 | 3 | 3 | — |
| 0.5* | 193 | 12.43 | 13.37 | 13.56 | 3 | 3 | — |
| 0.75* | 193 | 14.50 | 14.43 | 14.61 | 4 | 1 | — |
| 1* | 193 | 13.24 | 14.95 | 15.53 | 4 | 3 | — |

*dried 3 minutes at 121° C.

Table II which follows includes data showing the effect of the addition of a salt and/or an acid to the agent of the invention in connection with the use of the agent in the pad (except as noted) treatment of fabric of the same type as that described above for test evaluation of the agent of the invention. The methods used to apply the agent were substantially the same as those described above. The first column in Table II refers to the examples (hereinafter) in which the agent was made. Weight % concentrations shown are based on the total weight of the pad or exhaust bath.

TABLE II

| Agent from Ex. No. | Salt | Conc'n. (wt %) | Acid | pH or Conc'n.; wt % | Dry/Cure Temp. (°C.) | Dry/Cure Time (min.) | A.S. I | A.S. 5W | A.S. 10W | S.R. I | S.R. 5W | S.R. 10W |
|---|---|---|---|---|---|---|---|---|---|---|---|---|
| 1 | — | — | — | — | — | — | 12.56 | 14.69 | — | 3 | 1 | — |
| 4 | Diammonium citrate | 0.1 | — | — | 193 | 1.0 | 13.06 | 14.61 | 15.20 | 4 | 2 | 1 |
| 4 | Diammonium citrate | 0.2 | — | — | " | " | 12.13 | 13.33 | 13.23 | 4 | 3 | 2 |
| 4 | Diammonium citrate/ Sodium sulfate | 0.1/ 0.75 | — | — | " | " | 13.02 | 14.43 | 14.65 | 4 | 5 | 2 |
| 4 | Diammonium citrate/ Sodium sulfate | 0.2/ 0.75 | — | — | " | " | 11.97 | 13.39 | 13.47 | 4 | 4 | 3 |
| 9 | — | — | Polyacrylic M.W. 2,000 | (0.3%) | " | 0.5 | 11.75 | 13.59 | 14.13 | 4 | 3 | 3 |
| 9 | — | — | Polyacrylic M.W. 5,000 | (0.4%) | " | " | 11.65 | 13.43 | 13.61 | 4 | 4 | 3 |
| 16 | Calcium chloride | 0.6 | — | — | 199 | " | 11.88 | 13.65 | 14.25 | 4 | 2 | 2 |
| 16 | Calcium chloride | 0.4 | Citric | 4.0 | 193 | 1.0 | 11.84 | 13.47 | 13.95 | 5 | 4 | 2 |
| 16 | Sodium nitrate | 0.3 | Polyacrylic M.W. 5,000 | 5.5 | " | " | 11.65 | 13.03 | 13.11 | 5 | 5 | 3 |
| 18 | Calcium acetate | 0.6 | Citric | 4.0 | " | " | 11.96 | 13.84 | 13.20 | 4 | 4 | 1 |
| 18 | Calcium acetate | " | " | " | " | " | 11.69 | 13.19 | 13.23 | 4 | 4 | 2 |
| 18 | Calcium acetate | 0.93 | " | " | " | " | 12.15 | 14.18 | 13.96 | 4 | 4 | 1 |
| 18 | Calcium acetate | " | " | " | " | " | 11.56 | 13.04 | 14.01 | 4 | 5 | 2 |
| 18 | Calcium nitrate | 0.75 | " | " | " | " | 12.37 | 13.56 | 13.17 | 4 | 5 | 5 |
| 18 | Calcium | 1.25 | " | " | " | " | 12.63 | 13.96 | 13.18 | 4 | 5 | 3 |

TABLE II-continued

| Agent from Ex. No. | Salt | Conc'n. (wt %) | Acid | pH or Conc'n.; wt %) | Dry/Cure Temp. (°C.) | Dry/Cure Time (min.) | A.S. I | A.S. 5W | A.S. 10W | S.R. I | S.R. 5W | S.R. 10W |
|---|---|---|---|---|---|---|---|---|---|---|---|---|
| | nitrate | | | | | | | | | | | |
| 25 | Sodium nitrate | 0.45 | Citric | 4.0 | " | " | 11.93 | 13.00 | 13.61 | 3 | 5 | 5 |
| 25 | Zinc sulfate | 1.0 | " | " | " | " | 12.31 | 14.11 | 14.18 | 3 | 4 | 5 |
| 25 | Zinc nitrate | 1.0 | " | " | " | " | 13.25 | 14.39 | 14.07 | 3 | 3 | 2 |
| 25 | Magnesium sulfate | 0.5 | " | " | " | " | 12.11 | 13.39 | 13.73 | 3 | 5 | 5 |
| 25 | Magnesium nitrate | 0.8 | " | " | " | " | 12.23 | 13.41 | 13.47 | 3 | 3 | 5 |
| 1* | Sodium sulfate | 0.75 | — | — | 199 | 0.5 | 12.12 | 12.87 | 13.43 | 5 | 3 | 2 |
| 1 | Sodium sulfate | " | Tartaric | 4.0 | " | 1.0 | 11.65 | 12.94 | 13.56 | 4 | 4 | 4 |
| 1 | Sodium sulfate | " | Citric | 5.5 | " | " | 12.73 | 12.73 | 13.59 | 4 | 3 | 3 |
| 1 | Sodium sulfate | " | Glutaric | 4.0 | " | 1.25 | 12.13 | 13.53 | 13.59 | — | — | — |
| 1 | Sodium sulfate | " | Succinic | 4.0 | " | " | 12.12 | 13.61 | 15.01 | — | — | — |
| 1* | Calcium nitrate | " | — | — | " | 0.5 | 12.09 | 13.01 | 13.41 | 4 | 3 | 4 |
| 1* | $Na_2HOP_4 . 7H_2O$ | 1.0 | — | — | " | " | 11.96 | 13.03 | 13.61 | 5 | 3 | 4 |
| 1 | " | 0.75 | Tartaric | 4.0 | " | 1.0 | 12.27 | 13.25 | 14.24 | 3 | 4 | 3 |
| 1 | " | " | Citric | 5.5 | " | " | 11.23 | 12.73 | 13.43 | 3 | 3 | 3 |
| 1* | $Na_3PO_4 . 12H_2O$ | 1.25 | — | — | 193 | 0.5 | 12.06 | 13.13 | 13.35 | 4 | 3 | 4 |
| 1* | Magnesium chloride . $6H_2O$ | 0.5 | — | — | " | " | 12.33 | 13.33 | 13.73 | 3 | 3 | 2 |
| 1** | Sodium chloride | " | — | — | " | " | 12.56 | 13.33 | 14.04 | 4 | 3 | 3 |
| 1** | Sodium nitrate | " | — | — | " | " | 12.37 | 13.59 | 14.13 | 4 | 3 | 3 |
| 1 | Aluminum sulfate | " | — | — | 199 | 1.25 | 12.14 | 13.65 | 13.95 | 3 | 3 | — |
| 1* | Sodium oxalate | 0.4 | — | — | " | 0.5 | 12.04 | 13.00 | 13.61 | 5 | 3 | 2 |
| 1 | Sodium oxalate | 0.25 | Oxalic | 5.0 | " | 1.25 | 11.93 | 13.45 | 13.86 | 3 | 4 | 5 |
| 1 | Sodium oxalate | " | Citric | 5.5 | " | " | 11.59 | 13.39 | 13.21 | 4 | 2 | 2 |
| 1 | — | — | Succinic | 4.0 | " | " | 12.19 | 13.87 | 13.73 | — | — | — |
| 1 | — | — | Tartaric | 4.0 | " | 1.0 | 11.65 | 12.85 | 13.39 | 3 | 1 | — |
| 1 | — | — | " | 4.5 | " | " | 11.83 | 13.00 | 13.61 | 3 | 1 | — |
| 1 | — | — | " | 5.0 | " | " | 12.17 | 13.33 | 14.05 | 3 | 1 | — |
| 1 | — | — | " | 5.5 | " | " | 11.84 | 13.59 | 14.50 | 3 | 1 | — |
| 1 | — | — | " | 6.0 | " | " | 12.21 | 14.08 | 14.73 | 3 | 1 | — |
| 1 | — | — | Citric | 4.0 | " | " | 12.81 | 14.25 | 15.23 | 2 | 1 | — |
| 1 | — | — | " | 4.5 | " | " | 11.96 | 13.18 | 13.96 | 3 | 1 | — |
| 1 | — | — | " | 5.0 | " | " | 11.97 | 13.53 | 14.21 | 3 | 1 | — |
| 1 | — | — | " | 5.5 | " | " | 11.69 | 13.24 | 13.73 | 3 | 1 | — |
| 1 | — | — | " | 6.0 | 199 | 1.0 | 11.96 | 13.65 | 14.47 | 3 | 2 | 1 |
| 1 | — | — | Oxalic | 4.0 | " | " | 11.84 | 13.10 | 13.56 | 3 | 2+ | — |
| 1 | — | — | " | 4.5 | " | " | 12.01 | 13.13 | 13.69 | 3 | 2 | — |
| 1 | — | — | " | 5.0 | " | " | 11.56 | 12.84 | 13.35 | 3 | 1 | — |
| 1 | — | — | " | 5.5 | " | " | 12.05 | 11.93 | 14.43 | 3 | 1 | — |
| 1 | — | — | " | 6.0 | " | " | 11.98 | 13.96 | 14.47 | 3 | 1 | — |
| 1 | — | — | Boric | (0.05%) | " | " | 12.19 | 14.21 | 15.07 | 3 | 1 | — |
| 1 | — | — | " | (0.1%) | " | " | 12.25 | 14.61 | 14.98 | 3 | 1 | — |
| 1 | — | — | " | (0.2%) | " | " | 11.88 | 13.35 | 13.96 | 4 | 1 | — |
| 1 | — | — | " | (0.4%) | " | " | 13.11 | 14.59 | 15.73 | 3 | 1 | — |
| 1 | — | — | " | (0.6%) | " | " | 13.21 | 15.21 | 15.95 | 3 | 1 | — |
| 1 | — | — | 85% $H_3PO_4$ | 4.0 | " | 1.25 | 11.85 | 13.13 | 13.93 | 4 | 4 | — |
| 1 | — | — | " | 4.5 | " | " | 12.19 | 13.33 | 14.25 | 4 | 4 | — |
| 1 | — | — | " | 5.0 | " | " | 12.11 | 13.22 | 13.90 | 4 | 4 | — |
| 27 | — | — | — | — | 193 | 1.0 | 12.87 | 15.04 | 15.56 | 3–4 | 1 | 1 |
| 27 | Calcium nitrate | 0.75 | — | — | 199 | " | 11.73 | 13.99 | 13.45 | 4 | 3 | 3 |
| 28 | — | — | — | — | 193 | " | 13.13 | 14.69 | 15.47 | 3 | 1 | 1 |

*Applied to fabric by exhaust: 10 minutes at 66° C.
**Applied to fabric by exhaust: 10 minutes at 49° C.

Table III which follows includes data showing the effect of the addition of a salt and/or an acid to the agent of the invention in connection with the use of the agent in the treatment of fabrics other than that specified above in connection with the data included in Table II. In all cases, the agent of the invention used was that of Example 1. Thus, the headings of Tables II and III are the same except that in the latter the Example No.

heading has been replaced by the heading to designate the type of substrate fabric. Application of the agent was carried out by padding as already described above.

TABLE III

| Fabric | Salt | Conc'n. (wt %) | Acid | pH or (Conc'n.; wt %) | Dry/Cure Temp. (°C.) | Dry/Cure Time (min) | A.S. I | A.S. 5W | A.S. 10W | S.R. I | S.R. 5W | S.R. 10W |
|---|---|---|---|---|---|---|---|---|---|---|---|---|
| Woven Qiana® | calcium nitrate | 0.25 | Citric | 4.0 | 193 | 0.75 | 11.5 | 12.66 | 13.43 | 3 | 4 | 3 |
| Woven Qiana® | calcium nitrate | 0.75 | " | " | " | " | 11.89 | 13.03 | 14.19 | 3 | 3 | 3 |
| Woven Qiana® | sodium sulfate | 0.25 | " | " | " | " | 11.94 | 13.08 | 14.10 | 3 | 3 | 2 |
| Woven Qiana® | sodium sulfate | 0.75 | " | " | " | " | 11.79 | 12.70 | 13.73 | 3 | 3 | 3 |
| Woven Qiana® | $Na_2HPO_4 . 7H_2O$ | 1.0 | " | " | " | " | 12.25 | 13.50 | 14.65 | 3 | 3 | 2 |
| Woven Qiana® | " | 0.5 | " | " | " | " | 12.14 | 13.25 | 14.39 | 3 | 3 | 2 |
| Knit Qiana® | sodium sulfate | 0.75 | — | — | " | " | 11.73 | 12.63 | 13.25 | 5 | 5 | 3 |
| Knit Qiana® | sodium sulfate | 0.75 | Citric | 4.0 | " | " | 11.69 | 13.13 | 13.25 | 4 | 5 | 5 |
| Knit Qiana® | — | — | " | " | " | " | 12.08 | 12.90 | 13.47 | 3 | 5 | 4 |
| White Qiana® | sodium sulfate | 0.75 | " | " | 182 | 1.0 | 12.08 | 13.53 | 14.19 | 5 | 3 | 3 |
| White Qiana® | sodium sulfate | " | " | " | 193 | 0.5 | 11.87 | 13.99 | 14.73 | 5 | 3 | 2 |
| White Qiana® | sodium sulfate | " | " | " | " | 0.75 | 12.06 | 15.04 | 14.19 | 5 | 4 | 3 |
| Nomex® | — | — | Oxalic | " | 188 | 1.0 | 13.28 | 13.88 | 14.25 | 3 | 3 | — |
| Nomex® | sodium sulfate | 0.5 | Tartaric | " | " | " | 13.07 | 13.43 | 13.73 | 3 | 4 | — |
| Nomex® | sodium sulfate | " | Citric | " | " | " | 13.02 | 13.73 | 14.32 | 3 | 3 | — |
| Red Nylon Taffeta | calcium nitrate | 0.75 | " | " | 193 | 0.5 | 11.53 | 12.35 | 12.95 | 5 | 5 | — |
| Red Nylon Taffeta | calcium nitrate | 0.25 | " | " | " | " | 11.65 | 12.73 | 13.45 | 5 | 5 | — |
| Red Nylon Taffeta | sodium sulfate | 0.75 | " | " | " | " | 12.03 | 12.96 | 13.65 | 5 | 5 | — |
| Red Nylon Taffeta | sodium sulfate | 0.25 | " | " | " | " | 12.13 | 13.09 | 13.65 | 5 | 5 | — |
| Red Nylon Taffeta | $Na_2HPO_4 . 7H_2O$ | 1.0 | " | " | " | " | 12.09 | 13.45 | 14.24 | 5 | 5 | — |
| Red Nylon Taffeta | " | 0.25 | " | " | " | " | 12.07 | 13.15 | 13.23 | 5 | 5 | — |
| Dull Spun Acetate Suiting | " | 0.5 | " | " | 182 | 0.75 | 12.73 | 13.25 | 13.73 | 2 | 2 | — |
| Dull Spun Acetate Suiting | " | " | Tartaric | " | " | " | 12.94 | 13.31 | 13.96 | 2 | 2 | — |
| Dull Spun Acetate Suiting | — | — | Citric | " | " | " | 13.22 | 13.65 | 14.00 | 2 | 2 | — |
| Acetate | sodium sulfate | 0.5 | " | " | 199 | " | 12.39 | 13.41 | 14.73 | 3 | 5 | — |
| Acetate | $Na_2HPO_4 . 7H_2O$ | " | " | " | 182 | " | 12.45 | 13.53 | 14.25 | 2 | 5 | — |
| Acrilan® Type 16 Plain Weave | sodium sulfate | " | " | " | 182 | 0.75 | 11.87 | 12.27 | 13.24 | 3 | 2+ | — |
| Acrilan® Type 16 Plain Weave | $Na_2HPO_4 . 7H_2O$ | " | " | " | " | " | 12.25 | 13.00 | 13.88 | 3 | 2+ | — |
| Acrilan® Type 16 Plain Weave | — | — | Tartaric | " | " | " | 11.97 | 12.63 | 13.61 | 3 | 3− | — |
| Orlon® Type 75 Spun Yarn Plain Weave | $Na_2HPO_4 . 7H_2O$ | 0.5 | Citric | " | " | " | 12.31 | 13.50 | 14.25 | 3 | 2 | — |
| Orlon® Type 75 Spun Yarn Plain Weave | — | — | Tartaric | 5.0 | " | " | 12.56 | 14.05 | 14.35 | 2 | 2 | — |
| Arnel® Filament Tricot | $Na_2HPO_4 . 7H_2O$ | 0.5 | Citric | 4.0 | " | " | 12.70 | 13.59 | — | 3 | 3 | — |

TABLE III-continued

| Fabric | Salt | Conc'n. (wt %) | Acid | pH or (Conc'n.; wt %) | Dry/Cure Temp. (°C.) | Dry/Cure Time (min) | A.S. I | A.S. 5W | A.S. 10W | S.R. I | S.R. 5W | S.R. 10W |
|---|---|---|---|---|---|---|---|---|---|---|---|---|
| Arnel® Filament Tricot | " | " | Tartaric | " | " | " | 12.73 | 13.84 | — | 3 | 3 | — |
| Arnel® Filament Tricot | — | — | Citric | 5.0 | " | " | 13.10 | 14.25 | — | 3 | 3 | — |
| Spun Arnel® Plain Weave | $Na_2HPO_4 . 7H_2O$ | 0.5 | " | 4.0 | " | " | 12.01 | 13.25 | 13.61 | 2 | 2 | — |
| Spun Arnel® Plain Weave | sodium sulfate | " | Tartaric | " | " | " | 12.13 | 13.06 | 13.56 | 2 | 2 | — |
| Spun Arnel® Plain Weave | $Na_2HPO_4 . 7H_2O$ | " | " | " | " | " | 11.98 | 12.70 | 13.50 | 2 | 2 | — |
| Spun Arnel® Plain Weave | — | — | " | " | " | " | 12.17 | 13.35 | 13.98 | 2 | 2 | — |

The amount of agent of the invention applied to the substrate being treated therewith will vary with the substrate and the nature and extent of the effect desired. For most textile applications, however, it has been found that 0.4 to 2.0 weight % of the agent on the fabric, based on the weight of dry fabric, imparts excellent, durable, antistatic soil release characteristics to the fabric. Generally, the preferred amount is 0.8±0.1 weight %.

It also has been discovered in connection with this invention that the process of application of the agent of the invention to the substrate, as described herein, need not be followed in its entirety with respect to the treatment of certain substrates. More particularly, if the substrate is of sufficient polyacidic nature, the polyacidic compound described above need not, of necessity, be present in the treating bath. For example, fabrics made of fibers of acid-modified polymers, such as the commercially available acid-modified polyamides and acid-modified polyesters, can be usefully treated with the agent of the invention in the absence of the aforesaid requisite salt and/or polyacidic compound, that is, using only conventional aqueous treating bath ingredients, if sufficient acid-function is provided by the acid-modified polymer.

EXAMPLE 1

Preparation of Anhydrous p-Toluene Sulfonic Acid

To a 12 liter, 4-neck round bottom flask was added 9,072 g p-toluene sulfonic acid monohydrate which was heated under a nitrogen atmosphere to 115° C. The pressure was reduced to 220 mm and reduced further to 20 mm over the next 1.5 hours. The contents were held at 115°–117° C./22 mm for a total of 14 hours to obtain the theoretical amount of water. The molten anhydrous acid was packaged in 16 oz. plastic jars and purged with nitrogen before sealing with a tight cap.

Preparation of the 25 Mole Ethylene Oxide Adduct of a Mixture n-Dodecyl Alcohol, n-Tetradecyl Alcohol and n-Hexadecyl Alcohol (The $\overline{MW}$ is That of n-Tridecyl Alcohol) ($Y_2$)

To 600 g of mixed straight chain alcohols in a 3 liter round-bottom flask, 0.975 g of 58% sodium hydride dispersed in oil was added under a nitrogen atmosphere. The contents were heated to 147° C., and with rapid agitation, gaseous ethylene oxide was introduced below the surface of the liquid. The mixture was held at 155°±2° C., with 3,308 g gaseous ethylene oxide being introduced into the rapidly stirred liquid over a total of 40.5 hours. After cooling the mixture to 80° C. under nitrogen, 4.5 g anhydrous p-toluene sulfonic acid were added and the mixture was stirred an additional 0.5 hour. The clear product had a trace tinge of yellow and a $\overline{MW}$ of 1303.

Quaternization n-Octadecylamine-bis(25 Mole Ethylene Oxide Adduct) with Dimethyl Sulfate ($Y_3$)

A tared 12 liter round-bottom flask was loaded ⅔ to ¾ full with molten ETHOMEEN 18/60, a bis 25 mole ethylene oxide adduct of n-octadecylamine under a nitrogen atmosphere. The contents were dried at 78°–80° C. at 30 mm Hg pressure for 5.5 hours. A 6 g sample was titrated with 0.1 N HCl potentiometrically over a pH range of from 11.5 to 2.5. A plot of pH versus Ml. 0.1 N HCl indicated an equivalence point of 27.55 ml. HCl which calculates to 0.442 meq./g sample of basicity or MW of 2264. The flask and contents were weighed showing 10,459 g amine-polyethylene oxide adduct present. To this stirred material was added 582 g (440 ml.) dimethyl sulfate dropwise over a 4-hour period at 60°±1° C. The stirred mixture was held at 50°–55° C. for an additional 20 hours. Analysis with perchloric acid on an aliquot sample indicated no amine present. The $\overline{MW}$ of the product was 2390.

Drying of Hexakis(methoxymethyl)Melamine (X)

After thawing, 635 kg of hexakis(methoxymethyl)-melamine were charged into a 1135.6 liter enamel-lined kettle. This material was agitated at 135°–140° C. and 20–40 mm Hg pressure for 6 hours, using a moderate flow of nitrogen through the charge. After cooling to about 60° C., the vacuum was broken with dry nitrogen and the dried material was discharged into drums.

Preparation of Durable Antistatic Soil Release Agent

To a 1 liter, 4-neck round-bottom flask were added 49.5 g of methoxypolyethylene glycol, $\overline{MW}$ 550 which was dried at 170°–175° C. and 30 mm Hg for 2 hours. After cooling to 80° and breaking the vacuum with nitrogen, 117.3 g tridecyloxy polyethylene glycol, $\overline{MW}$ 1303, 215.1 g dimethyl sulfate quaternized n-octadecylaminebis(25 mole ethylene oxide adduct), 35.1 g dried hexakis(methoxymethyl)melamine and 2.49 g anhydrous p-toluene sulfonic acid were added to the flask. With a relatively rapid stream of nitrogen being purged through the stirred mixture, the temperature was raised to 94° C. After 50 minutes at 93°±1° C., most of the methanol by-product was distilled and the mixture became quite viscous. The rate of nitrogen purge was reduced. Within about 5 minutes, 2.89 g triethanol amine was added rapidly to the viscous condensate. The condensate temperature was reduced to about 85° C. and the agitation continued for an additional 15–20 minutes. The nitrogen purge was changed to a slow nitrogen sweep. A total of 8.2 g methanol was collected versus the theoretical 8.64 g amount.

To a rapidly stirred solution of about 3 g sodium bicarbonate in 600 g water in a blender, 200 g of the foregoing condensate were slowly added. An additional 200 g water were added and the pH was raised to 7.8 by adding another 1 g sodium bicarbonate. The resulting 20% yellowish solution had a 25° C. viscosity of 8,800 cps using a Brookfield viscometer.

The product was padded onto polyester double-knit fabric at a bath concentration adjusted for fabric wet-pickup so as to give an active ingredient level of 0.8 weight %, based on the weight of fabric. The pad bath also contained 0.75 weight % sodium sulfate, based on the total weight of the bath, and sufficient citric acid to achieve a pH of 4.0. The pad application was carried out with a Spartan® II padder using two passes and two nips. After padding, the treated fabric was dried and cured at 193° C. in a forced hot air oven for 60 seconds.

After testing and washing and drying according to the procedures given herein for Tables I to III, the following results were obtained:

| | Initial(1) | 5HW/TD(2) | 10HW/TD |
|---|---|---|---|
| Antistatic (Keithley Log R) | | | |
| Product | 11.84 | 13.14 | 13.43 |
| Cotton Control | 13.61 | 13.69 | 13.69 |
| Polyester Control | 15.28 | 15.30 | 16.19 |
| Soil Release ("Oily Soil III")(3) | | | |
| Product | 3–5 | 4+ | 3+ |
| Polyester Control | 1 | 1 | 1 |

(1)Rinsed before testing
(2)Home Wash/Tumble Dried
(3)A 5 rating shows no oily stain whatsoever

EXAMPLES 2 TO 45

The following Examples 2 to 45 are intended to show various embodiments of the agent of the invention and the characteristics thereof. The techniques used in the examples to prepare the agents and to apply them to polyester fabric for evaluation are substantially the same as those already described above. More specifically with regard to the application of the agent to fabric, the agent included 0.75 weight %, based on the weight of bath, of sodium sulfate and sufficient citric acid to achieve a pH of 4.0. Dry/cure was effected in 1.0 to 1.25 minutes at 193° to 199° C. Data summarizing Examples 1 to 45 are given in Table IV. All of the embodiments of the examples, except as noted above, are of the formula

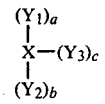

wherein X is

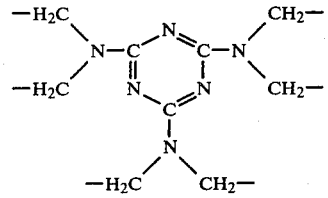

and $Y_1$, $Y_2$, $Y_3$, a, b and c are shown in the table. The various code designations shown in the table for $Y_1$, $Y_2$ and $Y_3$ are defined as follows:

| | |
|---|---|
| $A_1$ : | $O(C_2H_4O)_{12}CH_3$ |
| $A_2$ : | $O(C_2H_4O)_{15}$ straight chain $C_{13}H_{27}$ |
| $A_2'$: | $O(C_2H_4O)_{15}$ branched chain $C_{13}H_{27}$ |
| $B_2$ : | $O(C_2H_4O)_5$ straight chain $C_{13}H_{27}$ |
| $B_2'$: | $O(C_2H_4O)_5$ branched chain $C_{13}H_{27}$ |
| $C_2$ : | $O(C_2H_4O)_{25}$ straight chain $C_{13}H_{27}$ |
| $C_2'$: | $O(C_2H_4O)_{25}$ branched chain $C_{13}H_{27}$ |
| $D_2$ : | $O(C_2H_4O)_8$ straight chain $C_{13}H_{27}$ |
| $D_2'$: | $O(C_2H_4O)_8$ branched chain $C_{13}H_{27}$ |
| $E_2$ : | $O(C_2H_4O)_{45}$ straight chain $C_{13}H_{27}$ |
| $F_2$ : | $O(C_2H_4O)_{88}$ straight chain $C_{13}H_{27}$ |
| $A_3$ to $M_3$ : | $[(OC_2H_4)_m-N^{\oplus}(R_3)(R_4)-(C_2H_4O)_nH\ A^{\ominus}]$ |

wherein $A^{\ominus}$ is $^{\ominus}OSO_3CH_3$ and for $A_3$ to $M_3$ the following apply:

| | $R_3$ | $R_4$ | m + n |
|---|---|---|---|
| $A_3$: | $C_{18}H_{37}$ | $CH_3$ | 50 |
| $B_3$: | $C_{18}H_{37}$ | $CH_3$ | 16 |
| $C_3$: | $C_8H_{37}$ | $CH_3$ | 50 |
| $D_3$: | $C_{18}H_{35}$ | $CH_3$ | 24 |
| $E_3$: | $C_8H_{17}$ | $CH_3$ | 16 |
| $F_3$: | $C_{12}H_{25}$ | $CH_3$ | 42 |
| $G_3$: | $C_4H_9$ | $CH_3$ | 50 |
| $H_3$: | benzyl | $CH_3$ | 50 |
| $I_3$: | $C_8H_{17}$ | $CH_3$ | 24 |
| $J_3$: | $C_4H_9$ | $C_4H_9$ | 50 |
| $K_3$: | $C_4H_9$ | $CH_3$ | 12 |
| $L_3$: | $C_{12}H_{25}$ | $CH_3$ | 30 |
| $M_3$: | $C_8H_{17}$ | $CH_3$ | 100 |

In Example 44, X is

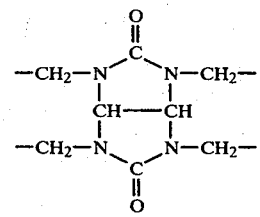

TABLE IV

| Ex. | Viscosity (pascal |
|---|---|

TABLE IV-continued

| No. | (a) | $Y_1$ | (b) | $Y_2$ | (c) | $Y_3$ | HLB | seconds) |
|---|---|---|---|---|---|---|---|---|
| 2 | 0 | — | 0 | — | 1 | $A_3$ | 15.4 | 1.300 |
| 3 | 1 | $A_1$ | 0 | — | 1 | $A_3$ | 15.1 | 1.330 |
| 4 | 2 | $A_1$ | 0 | — | 1 | $A_3$ | 16.6 | 0.560 |
| 5 | 0 | — | 2.3 | $A_2$ | 1 | $A_3$ | 15.6 | 8.280 |
| 6 | 0 | — | 2 | $A_2$ | 1 | $A_3$ | 15.6 | 0.580 |
| 7 | 0 | — | 2 | $B_2$ | 1 | $A_3$ | 14.5 | 8.200 |
| 8 | 0 | — | 1 | $C_2$ | 2 | $A_3$ | 16.7 | 2.000 |
| 9 | 1 | $A_1$ | 1.2 | $A_2$ | 1 | $A_3$ | 16.1 | 0.610 |
| 10 | 1 | $A_1$ | 1 | $A_2$ | 1 | $A_3$ | 16.1 | 4.600 |
| 11 | 1 | $A_1$ | 1 | $A_2$ | 1 | $A_3$ | 16.1 | 7.680 |
| 12 | 1 | $A_1$ | 1 | $A_2'$ | 1 | $A_3$ | 16.1 | 1.440 |
| 13 | 1 | $A_1$ | 1 | $D_2$ | 1 | $A_3$ | 15.8 | 3.200 |
| 14 | 1 | $A_1$ | 1 | $B_2'$ | 1 | $A_3$ | 15.6 | 0.824 |
| 14 | 1 | $A_1$ | 1 | $D_2'$ | 1 | $A_3$ | 15.8 | 2.720 |
| 15 | 1 | $A_1$ | 1 | $C_2$ | 1 | $A_3$ | 16.4 | 8.780 |
| 16 | 1 | $A_1$ | 1 | $E_2$ | 1 | $A_3$ | 17.0 | 6.180 |
| 18 | 0.8 | $A_1$ | 1.2 | $A_2$ | 1 | $A_3$ | 16.0 | 7.300 |
| 19 | 0.5 | $A_1$ | 1.5 | $A_2$ | 1 | $A_3$ | 15.8 | 5.900 |
| 20 | 0.8 | $A_1$ | 1.2 | $C_2$ | 1 | $A_3$ | 16.4 | 10.800 |
| 21 | 0.8 | $A_1$ | 1.2 | $C_2$ | 1 | $A_3$ | 16.4 | 5.740 |
| 22 | 0.5 | $A_1$ | 1.5 | $C_2$ | 1 | $A_3$ | 16.4 | 11.760 |
| 23 | 0.5 | $A_1$ | 1.5 | $C_2$ | 1 | $A_3$ | 16.4 | 4.120 |
| 24 | 1 | $A_1$ | 1 | $C_2$ | 1 | $A_3$ | 16.5 | 6.060 |
| 25 | 1 | $A_1$ | 1 | $C_2$ | 1 | $A_3$ | 16.5 | 8.800 |
| 26 | 1 | $A_1$ | 1 | $C_2$ | 1 | $A_3$ | 16.5 | 8.960 |
| 27 | 1 | $A_1$ | 1 | $C_2$ | 1 | $A_3$ | 16.5 | 2.400 |
| 28 | 1 | $A_1$ | 1 | $C_2$ | 1 | $A_3$ | 16.5 | 2.400 |
| 29 | 1 | $A_1$ | 1 | $C_2$ | 1 | $B_3$ | 14.9 | 4.450 |
| 30 | 1 | $A_1$ | 1 | $C_2$ | 1 | $C_3$ | 17.1 | 1.820 |
| 31 | 1 | $A_1$ | 1 | $C_2$ | 1 | $C_3$ | 17.1 | 8.050 |
| 32 | 1 | $A_1$ | 1 | $C_2$ | 1 | $D_3$ | 15.5 | 7.600 |
| 33 | 1 | $A_1$ | 1 | $C_2$ | 1 | $E_3$ | 15.7 | 1.800 |
| 34 | 1 | $A_1$ | 1 | $C_2$ | 1 | $F_3$ | 16.7 | 0.950 |
| 35 | 1 | $A_1$ | 1 | $C_2$ | 1 | $F_3$ | 16.7 | 2.700 |
| 36 | 1 | $A_1$ | 1 | $C_2$ | 1 | $G_3$ | 17.3 | 2.712 |
| 37 | 1 | $A_1$ | 1 | $C_2$ | 1 | $H_3$ | 17.2 | 2.770 |
| 38 | 1 | $A_1$ | 1 | $C_2$ | 1 | $I_3$ | 16.2 | 12.700 |
| 39 | 1 | $A_1$ | 1 | $C_2$ | 1 | $J_3$ | 17.2 | 6.200 |
| 40 | 1 | $A_1$ | 1 | $C_2$ | 1 | $K_3$ | 15.8 | 1.000 |
| 41 | 1 | $A_1$ | 1 | $C_2$ | 1 | $L_3$ | 16.3 | 2.750 |
| 42 | 1 | $A_1$ | 1 | $B_2$ | 1 | $A_3$ | 15.6 | 0.420 |
| 43 | 1 | $A_1$ | 1 | $F_2$ | 1 | $A_3$ | 17.8 | 2.860 |
| 44 | 1 | $A_1$ | 1 | $C_2$ | 1 | $A_3$ | 16.8 | 4.200 |
| 45 | 1 | $A_1$ | 1 | $C_2'$ | 1 | $A_3$ | 16.5 | 4.360 |

| Ex. | A.S. | | | S.R. | | |
|---|---|---|---|---|---|---|
| No. | I | 5W | 10W | I | 5W | 10W |
| 2 | 11.96 | 12.07 | 12.95 | 3 | 3 | 2 |
| 3 | 11.89 | — | 12.99 | 4 | 3 | 3 |
| 4 | 11.98 | 14.25 | 13.47 | 4 | 4-5 | 5 |
| 5 | 11.65 | 13.33 | 14.03 | 4 | 4 | 4 |
| 6 | 12.59 | 13.85 | 14.13 | 4 | 4 | 3 |
| 7 | 11.69 | 13.30 | 13.53 | 4 | 3 | 2 |
| 8 | 11.73 | 13.18 | 13.73 | 4 | 4 | 3 |
| 9 | 11.59 | 13.19 | 13.08 | 4 | 5 | 3 |
| 10 | 11.78 | 13.03 | 13.41 | 4 | 3 | 3 |
| 11 | 11.73 | 13.08 | 13.59 | 3 | 2 | 2 |
| 12 | 11.77 | 12.99 | 13.98 | 4 | 4 | 3 |
| 13 | 11.79 | 14.11 | — | 4 | 3 | — |
| 14 | 11.62 | 12.90 | 13.61 | 4 | 3 | 2 |
| 15 | 11.91 | 13.03 | 13.43 | 4 | 4 | 3 |
| 16 | 11.69 | 12.95 | 13.43 | 4 | 4 | 3 |
| 17 | 12.17 | 13.37 | 13.56 | 4 | 4 | 3 |
| 18 | 11.79 | 13.43 | 13.13 | 4 | 4 | 2 |
| 19 | 11.73 | 13.19 | 13.22 | 4 | 4 | 3 |
| 20 | 11.94 | 12.88 | 13.13 | 5 | 4 | 3 |
| 21 | 12.04 | 13.13 | 13.47 | 4 | 4 | 3+ |
| 22 | 11.45 | 13.13 | 13.53 | 4 | 2 | 3 |
| 23 | 11.97 | 13.18 | 13.25 | 3 | 4 | 3 |
| 24 | 11.73 | 13.41 | 13.95 | 4 | 4 | 3 |
| 25 | 11.84 | 13.14 | 13.43 | 3 | 4 | 3 |
| 26 | 12.03 | 13.25 | 13.73 | 4 | 4 | 3 |
| 27 | 11.41 | 12.73 | 13.61 | 3 | 3 | 2 |
| 28 | 11.62 | 12.83 | 13.07 | 3 | 3 | 1 |
| 29 | 12.28 | 13.20 | 13.49 | 3 | 2 | 2 |
| 30 | 11.81 | 12.53 | 13.04 | 4 | 4 | 2 |
| 31 | 11.50 | 12.39 | 12.88 | 4 | 2 | 1 |
| 32 | 11.62 | 13.19 | 12.95 | 4 | 4 | 3 |
| 33 | 11.95 | 13.11 | 13.98 | 5 | 4 | 4 |
| 34 | 11.30 | 12.59 | 12.73 | 3 | 1 | 1 |

TABLE IV-continued

| | | | | | | |
|---|---|---|---|---|---|---|
| 35 | 11.29 | 12.59 | 12.70 | 3 | 2 | 1 |
| 36 | 12.14 | 13.02 | 14.20 | 4 | 4 | 2 |
| 37 | 11.86 | 13.53 | 13.69 | 3 | 2 | 2 |
| 38 | 12.14 | 12.70 | 13.39 | 4 | 3 | 2 |
| 39 | 11.65 | 13.07 | 14.03 | 3 | 1 | — |
| 40 | 11.56 | 14.02 | — | 4 | 1 | 1 |
| 41 | 11.69 | 13.45 | 13.69 | 3 | 4 | 3 |
| 42 | 11.69 | 13.33 | 13.43 | 4 | 3 | 3 |
| 43 | 12.23 | 13.92 | 13.98 | 3 | — | — |
| 44 | 11.85 | 13.37 | 13.95 | 3 | — | — |
| 45 | 11.65 | 13.39 | 13.53 | 3 | — | — |

EXAMPLE 46

The purpose of this example is to show the anti-soil redeposition characteristic of the agent of the invention. Unlike the other advantageous characteristics of the agent, there is no industry-accepted or standard test for measurement of soil redeposition. The test employed herein, in general, is the same as the aforesaid home laundering AATCC Test Method 124, using Table I, III Machine, except as noted below. The test is carried out using redeposition soil consisting of, on a weight basis:

| | |
|---|---|
| Germantown Lamp Black | 9.7 parts |
| Crisco ® | 29.1 parts |
| Nujol ® | 41.8 parts |
| Wheat starch(screened through a 100-mesh sieve, U.S. Sieve Series) | 19.4 parts |
| Total parts: | 100.0 |

The Crisco ® and Nujol ® are heated to 38° C. and the lamp black and starch are added with stirring at this temperature until a homogeneous mixture is obtained. The redeposition soil is stored under refrigeration until used. The treated fabric samples, prepared as described above, are washed, along with the ballast load fabric. The redeposition soil is added along with the detergent (10 grams of soil are admixed with 50 grams of Tide ® commercially available detergent; a paste is formed by admixing in the presence of 100 ml ($0.1\times10^{-3}$ $m^3$) of 82°-93° C. in water). The soil is uniformly dispersed in the washing machine before the ballast and test samples are introduced. Washing is carried out under the normal wash cycle (12 minutes) using a hot water temperature of 60°±3° C. After the test samples are dried, as described hereinabove, they are compared with corresponding unsoiled fabric samples using the AATCC Gray Scale, the higher the evaluation number, the less is the stain. Table V which follows provides soil redeposition data for untreated and treated (with the agent of the invention) fabrics. The soiling procedure was carried out on fabric samples treated with the agent of the invention and on such samples which had been washed 5× and 10×, that is, washed 5× and 10× after application of the agent before being subjected to the soiling procedure. The agent was applied to the fabric, by the procedure already given, with curing in the presence of sodium sulfate/citric acid being carried out for 1 minute at the temperature indicated in the table.

TABLE V

| Agent from Ex. No. | Cure Temp. (°C.) | Gray Scale Reading I | 5W | 10W |
|---|---|---|---|---|
| 1* | 182 | 4 | 3 | 3 |

TABLE V-continued

| Agent from Ex. No. | Cure Temp. (°C.) | Gray Scale Reading I | 5W | 10W |
|---|---|---|---|---|
| 27** | 199 | 5/4 | 5/4 | 5/4 |
| 28** | 199 | 5/4 | 5/4 | 5/4 |
| Untreated fabric* (Control) | — | 3 | 1 | 1 |
| Untreated fabric** (Control) | — | 2 | 2 | 2 |

*white Qiana®
**polyester

Experiments 1 to 5

The following Experiments 1 to 5 are intended to show various compositions which fail to meet the aforesaid requirements of the invention and which, therefore, are outside the invention. Data summarizing Experiments 1 to 5 are given in Table VI. The definitions of formula terms and code designations are the same as given above for Examples 1 to 45 (in all cases, X is the same as in said examples, excluding Example 44).

TABLE VI

| Expt. No. | (a) | $Y_1$ | (b) | $Y_2$ | (c) | $Y_3$ | HLB | Viscosity (pascal seconds) | A.S. I | A.S. 5W | A.S. 10W | S.R. I | S.R. 5W | S.R. 10W |
|---|---|---|---|---|---|---|---|---|---|---|---|---|---|---|
| 1 | 0 | — | 0 | — | 1 | $G_3$ | 16.8 | 0.025 | 12.86 | 14.08 | 14.43 | 1 | — | — |
| 2 | 1 | $A_1$ | 1.2 | $A_2$ | 1 | $A_3$ | 16.1 | 0.236 | 12.77 | 15.25 | 15.73 | 4 | 4 | 3 |
| 3 | 1 | $A_1$ | 1.2 | $A_2$ | 1 | $A_3$ | 16.1 | 0.082 | 12.41 | 13.88 | 14.50 | 4 | 2 | 2 |
| 4 | 1 | $A_1$ | 1 | $C_2$ | 1 | $M_3$ | 18.1 | 1.570 | 12.41 | 13.61 | 14.47 | 3 | 3 | — |
| 5 | 1 | $A_1$ | 1 | $F_2$ | 1 | $C_3$ | 18.2 | 3.700 | 12.50 | 13.95 | 14.96 | 3 | 3 | 2 |

BEST MODE FOR CARRYING OUT THE INVENTION

Depending on capabilities of the mill in which the invention is used and the dictates of the market place, the best mode for carrying out the invention resides in pad or exhaust application to dyed or undyed fabric made from 100% polyester filament. The concentration of the bath depends on the method used and, in the case of exhaust application, on the weight of the goods. It should be such that about 0.8% by weight of the agent of this invention is deposited on the fabric. About 7 g of $Na_2SO_4$ is used per liter of bath to give a cloud point of about 65° C. For a pad operation, citric acid is used in an amount sufficient to give a pH of about 4.5. The treated fabric is dried and cured at about 193° C. for about 75 seconds in a pad application and about 30 seconds in an exhaust application.

I claim:

1. Antistatic soil release agent which (i) can be applied to a substrate by the exhaust technique, (ii) has durability to wear and laundering and resistance to yellowing on the substrate treated therewith, (iii) is capable of providing said durability by being cured at about 199° C. for 60–75 seconds and (iv) is of the formula

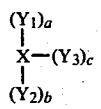

wherein

X is an aminoplast resin moiety having amino nitrogen atoms and 4 to 6 methylene groups, each of which methylene groups is attached to an amino nitrogen atom;

$Y_1$ is $O(C_2H_4O)_{5\text{-}20}R_1$;

$R_1$ is $C_{1\text{-}5}$ alkyl;

$Y_2$ is $O(C_2H_4O)_{5\text{-}88}R_2$;

$R_2$ is $C_{6\text{-}20}$ alkyl;

$Y_3$ is

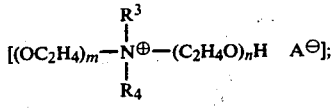

$R_3$ is $C_{4\text{-}20}$ alkyl, $C_{4\text{-}20}$ alkenyl or benzyl;

$R_4$ is $C_{1\text{-}4}$ alkyl;

$A^{\ominus}$ is an organic or inorganic anion;

each of a and b can be 0 to 2, provided that the sum of a and b is 1 to 2;

c is 1 to 2;

the sum of a, b and c is 2 to 4;

each of m and n is at least 1 and the sum of m and n is 12 to 100;

said agent having a calculated hydrophile-lipophile balance (HLB) of 14.5 to 18.0, a 20 weight % aqueous solution viscosity, as measured at 20° C. on a Brookfield viscometer, of 0.250 to 16.000 pascal seconds, an electrical resistivity (Keithley log R) on polyester fabric, at 20±2% relative humidity and 23°±1° C., of no greater than 13.00 initially and no greater than 14.25 after ten washes, and a soil release rating on polyester fabric of at least 3 initially.

2. Agent of claim 1 wherein each of a and b is 1 or one of them is 0 and the other is 2.

3. Agent of claim 2 wherein X is

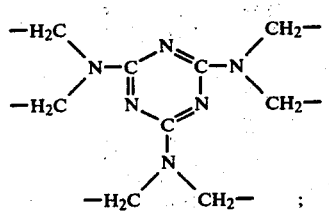

$Y_1$ is $O(C_2H_4O)_{10\text{-}16}CH_3$;

$Y_2$ is $O(C_2H_4O)_{15\text{-}30}C_{13}H_{27}$;

$R_3$ is $C_{8\text{-}18}$ alkyl;

$R_4$ is $CH_3$;

$A^{\ominus}$ is $^{\ominus}OSO_3CH_3$; and m+n is 20 to 50.

4. Agent of claim 1 wherein HLB is 15.5 to 17.0 and the viscosity is 2.000 to 8.000 pascal seconds.

5. Agent of claim 1 wherein a is greater than 0.

6. Agent of claim 1 wherein b is greater than 0.

7. Agent of claim 1 dispersed or dissolved in a normally liquid medium.

8. Agent of claim 7 wherein the normally liquid medium is water.

9. Agent of claim 8 dissolved in water to form a 20 weight % aqueous solution.

10. Agent of claim 9 wherein the aqueous solution includes sodium sulfate and citric acid.

11. Agent of claim 9 wherein the aqueous solution includes calcium nitrate and citric acid.

12. Agent of claim 9 wherein the aqueous solution includes calcium nitrate.

13. Agent of claim 9 wherein the aqueous solution includes a polyacidic compound having a second dissociation constant greater than $1\times10^{-8}$.

14. Agent of claim 12 wherein the polyacidic compound is phosphoric, citric, oxalic, tartaric, succinic, glutaric or polyacrylic acid.

15. Agent of claim 12 wherein the polyacidic compound is polyacrylic acid having a molecular weight of up to about 5,000.

16. Agent of claim 9 wherein the aqueous solution includes a salt of a mono-, di- or trivalent metal or of an ammonium cation.

17. Agent of claim 16 wherein the salt is the nitrate, phosphate, chloride, sulfate, oxalate, acetate or citrate of a sodium, magnesium, calcium, zinc, aluminum or an ammonium cation.

18. Agent of claim 16 wherein the aqueous solution includes a polyacidic compound having a second dissociation constant greater than $1\times10^{-8}$.

19. Substrate treated with the agent of claim 1.

20. Substrate of claim 19 which is a polyester textile fabric.

21. Substrate of claim 19 which is a polyamide textile fabric.

* * * * *